US005111252A

United States Patent [19]

Hamada et al.

[11] Patent Number: 5,111,252

[45] Date of Patent: May 5, 1992

[54] ELECTROPHOTOGRAPHIC COPYING MACHINE WITH PAPER FEEDING AND DISCHARGE TRAYS

[75] Inventors: Fumihiko Hamada, Ogaki; Kunio Tsuboi, Kanzaki; Mitihiko Hasegawa, Taka; Yasuji Ichizawa, Yoro; Toshiya Yabe, Ogaki; Kunitomo Yamasaki, Anpachi; Yasunobu Takahashi, Kanzaki; Katsuji Mizuta, Hashimi, all of Japan

[73] Assignee: Sanyo Electric Co., Ltd., Osaka, Japan

[21] Appl. No.: 571,858

[22] Filed: Aug. 22, 1990

[30] Foreign Application Priority Data

Aug. 23, 1989 [JP] Japan ..... 1-98284[U]
Aug. 23, 1989 [JP] Japan ..... 1-98285[U]
Aug. 23, 1989 [JP] Japan ..... 1-98572[U]

[51] Int. Cl.[5] ..... G03G 21/00

[52] U.S. Cl. ..... 355/308; 271/171; 271/213; 355/311; 355/321

[58] Field of Search ..... 271/127, 171, 207, 213, 271/220; 355/308, 309, 311, 321, 210

[56] References Cited

FOREIGN PATENT DOCUMENTS 0144045 8/1983 Japan ..... 271/213
0106270 5/1988 Japan ..... 271/213

*Primary Examiner*—A. T. Grimley
*Assistant Examiner*—P. J. Stanzione
*Attorney, Agent, or Firm*—Darby & Darby

[57] ABSTRACT

An electrophotographic copying machine includes a paper feeding tray and a paper discharging tray respectively attached to both end surfaces of a body, each of which has a first, a second and a third tray plates which are rotatably connected to each other. When the machine is not used, the first, second and third tray plates are contained in the body in a state where the same are collapsed and folded over each other and, when the machine is used, the first, second and third tray plates are withdrawn and developed. A plurality of ribs which are extended in a paper feeding direction are on one upper surface of the first plate attached to the body in a rotatable manner, and a plurality of through holes, or slits, which receive the ribs when the first, second and third tray plates are collapsed are formed on the second and third tray plates.

15 Claims, 13 Drawing Sheets

ELECTROPHOTOGRAPHIC COPYING MACHINE WITH PAPER FEEDING AND DISCHARGE TRAYS

BACKGROUND OF THE INVENTION

1. Field of the Invention

The present invention relates to an electrophotographic copying machine. More specifically, the present invention relates to an electrophotographic copying machine in which a manual paper feeding tray and a paper discharging tray are respectively attached to both side surfaces of a body.

2. Description of the Prior Art

For example, in Japanese Utility Model Publication No. 62-25486 published on Jun. 30, 1987, a paper discharging tray which is attached to a copying machine body to be folded or collapsed and retracted therein is disclosed. In addition, a commercially available electrophotographic copying machine "Z-30" manufactured by Sharp Corporation, for example is provided with a twice-collapsible paper discharging tray and another commercially available electrophotographic copying machine "3525" manufactured by Fuji Xerox Corporation, for example is provided with a manual paper feeding tray having the double-retractable structure. However, in such prior art, there were disadvantages set forth in the following.

More specifically, in the paper discharging tray disclosed in Japanese Utility Model Publication No. 62-25486, it is impossible to change the length thereof, and therefore, it is necessary to develop the paper discharging tray irrespective of a size of a copying paper whenever the copying machine is used. Accordingly, it is necessary to always ensure a wide space for the paper discharging tray and this becomes an obstacle to space-saving.

In addition, in the electrophotographic copying machine "Z-30" manufactured by Sharp Corporation, it is possible to change the length of the paper discharging tray; however, if the same is intended to be changed in the thrice-collapsible structure, there is possibility that a copied paper to be discharged is caught on the discharging tray and the paper is hindered from being smoothly discharged.

Furthermore, in the electrophotographic copying machine "3525" manufactured by Fuji Xerox Corporation, since the paper feeding tray is a retractable tray, it is impossible to fold or collapse the tray, and therefore, it is necessary to always ensure a space for a minimal length of the tray. Accordingly, there is a problem in a point of space-saving.

SUMMARY OF THE INVENTION

Therefore, a principal object of the present invention is to provide a novel electrophotographic copying machine.

Another object of the present invention is to provide an electrophotographic copying machine which is provided with a collapsible paper feeding tray and a collapsible paper discharging tray which are excellent in operability.

Another object of the present invention is to provide an electrophotographic copying machine capable of saving a space.

Another object of the present invention is to provide an electrophotographic copying machine in which a copied paper is not caught on a paper discharging tray.

Another object of the present invention is to provide an electrophotographic copying machine in which it is possible to easily remove a jam of a copying paper which is fed from a paper feeding tray.

Another object of the present invention is to provide an electrophotographic copying machine provided with a paper guide which is changeable according to two different series of paper size.

The other object of the present invention is to provide an electrophotographic copying machine in which it is possible to easily determine an image on an original is copied in what position or place on a copying paper.

SUMMARY OF THE INVENTION

An electrophotographic copying machine in accordance with the present invention comprises: a body; a paper feeding tray attached to one side surface of the body, said paper feeding tray having first, second and third paper feeding tray plates which are connected to each other in a collapsible manner so that the third paper feeding tray plate can be wound therein, and said first, second and third paper feeding tray plates being contained in the body in a state where the same are collapsed; and a paper discharging tray attached to the other side surface of the body, said paper discharging tray having a first, second and third paper discharging tray plates which are connected to each other in a collapsible manner so that the third paper discharging tray plate can be wound therein, and said first, second and third paper discharging tray plates being contained in the body in a state where the same are collapsed.

The first, second and third tray plates of each of the paper feeding tray and the paper discharging tray are collapsed such that the third tray plate can be wound inward and accommodated within the body when the electrophotographic copying machine is not used. At this time, the first tray plate is positioned at the most outer surface. When the electrophotographic copying machine is to be used, all or a portion of the first, second and third tray plates are developed in accordance with a desired size of a copying paper. For example, a copying paper of a minimum size is used, the paper feeding tray or the paper discharging tray is withdrawn from the body in a state where the second and third tray plates remain in a collapsed state. When a copying paper of an intermediate size is used, the second tray plate is lifted-up to be developed in a state where the third tray plate remains in a collapsed state. When a copying paper of a maximum size is used, all of the first, second and third tray plates are developed.

In accordance with the present invention, since both of the paper feeding tray and the paper discharging tray are constructed to be collapsible, the same can be contained or accommodated within the body when the electrophotographic copying machine is not used. In addition, it is sufficient to develop only necessary tray plates for a paper size, and therefore, in comparison with the aforementioned prior arts in which a space more than a predetermined size is always required, the present invention is advantageous in space saving.

In one embodiment in accordance with the present invention, guide means are provided between the paper feeding tray and a paper feeding roller in the body, and the guide means includes a guide holder of a box shape; a pinion accommodated in the guide holder in a rotatable manner; first and second racks arranged in parallel with each other so as to sandwich the pinion, said first and second racks being detachably attached to the guide holder, and said first rack having a first projection formed to be able to be projected or retracted in a direction intersecting a movement direction of the first rack; a plurality of first notches which are formed on the guide holder on a portion being brought in contact with the first rack and engage with the first projection at different positions; and a plurality of second notches formed on the guide holder at a portion being brought in contact with said second rack and engage with said first projection at different positions.

In accordance with this embodiment, it is possible to deal with different systems of paper size only by loading the first rack and the second rack to the guide holder alternately, and therefore, it is not necessary to prepare guide means for each system of paper size, and therefore, it is possible to reduce a manufacturing cost of an electrophotographic copying machine.

In another aspect of the present invention, guide means are provided between the paper feeding tray and a paper feeding roller in the body, and the guide means includes a guide plate provided in a rockable manner, a tip end of said guide plate being positioned below the paper feeding roller; a first spring for pressure-contacting the tip end of the guide plate against a peripheral surface of the paper feeding roller; and detaching means for detaching the tip end of the guide plate from the peripheral surface of the paper feeding roller, and further comprises an arm provided in the vicinity of the peripheral surface of the paper feeding roller in a rockable manner; a friction pad provided on one end of the arm; a second spring for acting on the arm and for pressure-contacting the friction pad against the peripheral surface of the paper feeding roller; and means for separating the friction pad from the peripheral surface of the paper feeding roller against the second spring when the detaching means is operated.

In accordance with this embodiment of the present invention, it is possible to separate the friction pad from the peripheral surface of the paper feeding roller only by operating the detaching means, and therefore, even if a paper jam occurs in a state where a toner is adhered on the copying paper, it is possible to remove the copying paper which occurs during the jam while the peripheral surface of the paper feeding roller is not smudged by the toner of the copying paper.

In a further aspect of the present invention, the electrophotographic copying machine further comprises an table for holding the original to be copied formed above the body; a first indicator formed on one end edge of the original table; and a second indicator formed in association with the paper feeding tray, said second indicator having the same symbols as that of said first indicator, whereby it can be determined whether an image of an original put on the original table is copied at what position of the copying paper.

In accordance with this embodiment, it is possible to know in advance a position of a specific image on the original to be copied on what portion of the copying paper when the original is copied on the copying paper, and therefore, not only it is possible to reduce waste of the copying paper but also a working efficiency in copying can be increased.

The objects and other objects, features, aspects and advantages of the present invention will become more apparent from the following detailed description of the embodiments of the present invention when taken in conjunction with accompanying drawings.

DETAILED DESCRIPTION OF THE PREFERRED EMBODIMENTS

Figure 1:
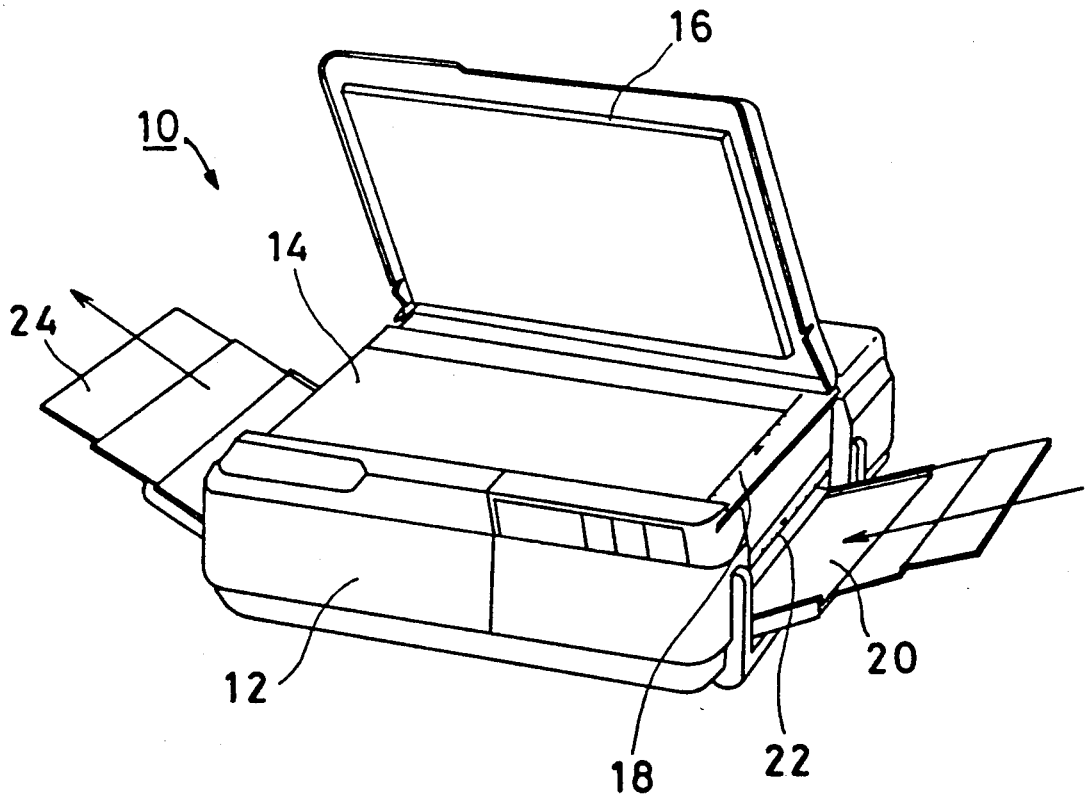
FIG. 1 is a perspective view showing one embodiment in accordance with the present invention.

With reference to FIG. 1, an electrophotographic copying machine the preferred embodiment shown includes a body 12 which is provided with an original table 14 made of a glass on an upper surface thereof. An original cover 16 is attached to the upper surface of the body 12 so as to open or close the original table 14. On the upper surface of the body 12, an indicator 18 which indicates that an original (not shown) should be put on what position of the original table 14 is provided along one side end edge of the original table 14 (in this embodiment shown, a side end edge at a paper feeding side).

A paper feeding tray 20 for manual feeding which is collapsible is attached to one side end surface of the body 12. An indicator 22 is attached on the one side end surface of the body 12 above a paper feeding port through which a copying paper (not shown) from the paper feeding tray 20 is taken in the body 12. The indicator 22 has the same symbols as that of the above described indicator 18 as described later, and therefore, an operator can easily determine with reference to the indicators 18 and 22 whether the image on the original is copied at what position on the copying paper.

On the other side surface of the body 12, a paper discharging tray 24 is attached through which the copying paper fed from the manual paper feeding tray 20 and processed in the body 12 is discharged. As similar to the above described paper feeding tray 20, the paper discharging tray 24 is formed in a collapsible manner. However, a specific structure thereof will be described later in detail.

Figure 2:
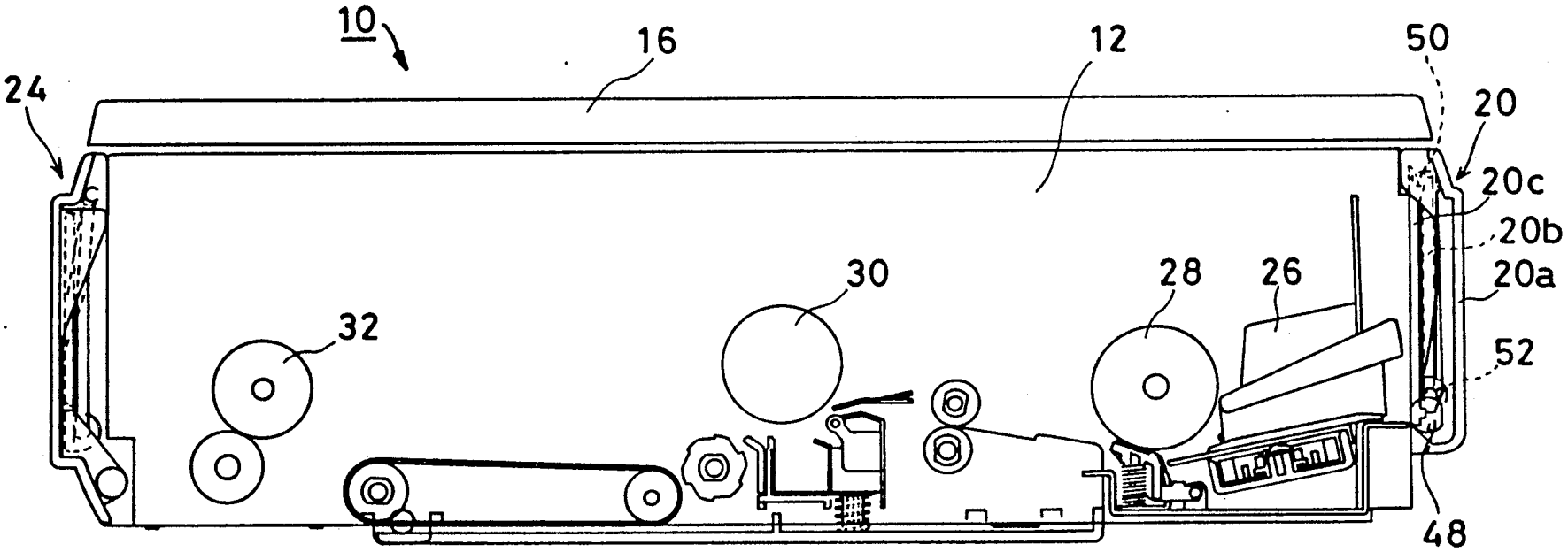
FIG. 2 is an illustrative view showing in simplified form the internal structure of FIG. 1 embodiment.

As shown in FIG. 2, in an interior of the body 12, a guide 26 which guides a copying paper (not shown) from the paper feeding tray 20 to a paper feeding roller 28. A copying paper which is guided by the guide 26 and picked-up by the paper feeding roller 28 is sent to the vicinity of a photosensitive drum 30 through a predetermined path, and a toner image is transferred on the copying paper by a toner image forming means (not shown) at that position. In addition, as well known, the toner image forming means includes a latent image forming means for forming a latent image by irradiating a light image of the original put on the original table 14 onto the photosensitive drum 30, a toner developing means developing the latent image by a toner, and a transferring means for transferring a toner image on the photosensitive drum 30 onto the copying paper. The copying paper on which the toner image is transferred is sent to a fixing roller 32 through a predetermined path and the toner image is fixed to the copying paper by the fixing roller 32. Then, the copying paper is discharged on the paper discharging tray 24.

Figure 3:
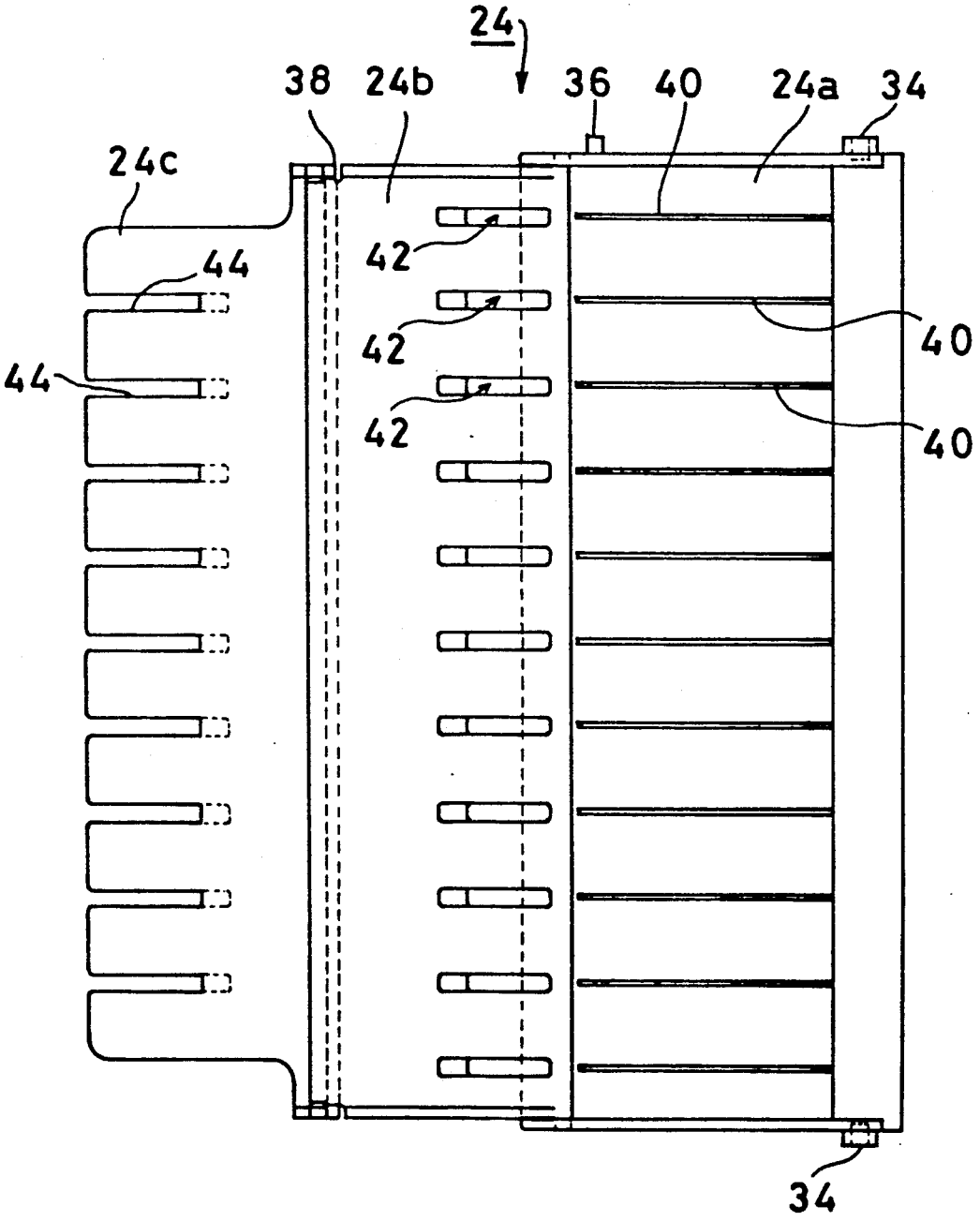
FIG. 3 is an illustrative view showing a paper discharging tray of FIG. 1 embodiment.

As shown in FIG. 3, the paper discharging tray 24 includes a first, a second and a third tray plates 24*a*, 24*b* and 24*c* which are constructed to be foldable or collapsible.

Figure 4A:
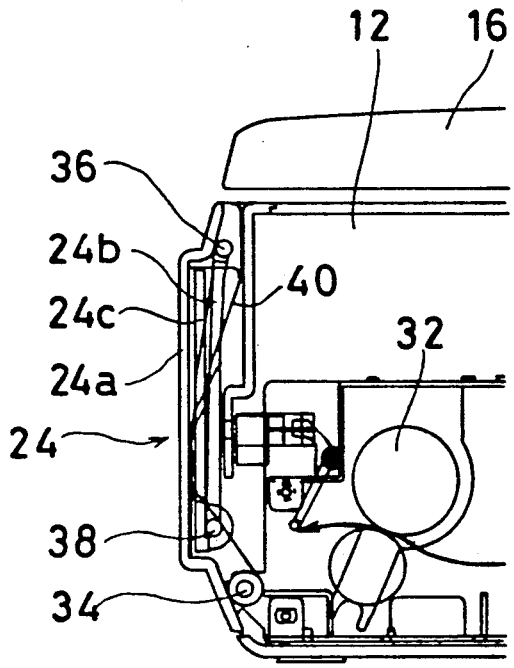
FIGS. 4A–4D are illustrative views showing major portions of the paper discharging tray in different states.

A supporting shaft 34 is provided on both side surfaces of the tray plate 24*a* at a base end thereof, and the tray plate 24*a* is attached to the body 12 in a rotatable manner as shown in FIG. 4A by the supporting shaft 34. The three tray plates 24*a*–24*c* are connected to each other in a rotatable manner by connecting shafts 36 and 38. However, any of the tray plates 24*a*–24*c* is constructed such that the same can not be rotated more than a predetermined angle in a counterclockwise direction.

On an upper surface of the tray plate 24*a*, a plurality of ribs 40 which extend in a direction in parallel with a movement direction of the copying paper are formed at predetermined intervals in a direction orthogonally intersecting the movement direction of the copying paper. As well seen from FIGS. 4A–4D, each of the ribs 40 is inclined so that a height thereof becomes higher from approximately center of the movement direction of the copying paper toward the tray plate 24*b*. Then, on the tray plates 24*b* and 24*c*, through holes or slits, 42 and 44 which extend in the same direction as an extended direction of the ribs 40 are respectively formed. Each of the through holes, or slits, 42 and 44 receives an inclined portion of corresponding one of the ribs 40 in a state where the tray plates 24*a*–24*c* are collapsed as shown in FIG. 4A.

Then, when the paper discharging tray 24 is not used, as shown in FIG. 4A, the tray plates 24*a*–24*c* are collapsed and contained in the body 12. If the paper discharging tray 24 is withdrawn from the body 12 in a direction of an arrow mark 42 shown in FIG. 4B, the same is developed so that a copying paper of a minimum size can be put thereon in a state where the tray plates 24*a*–24*c* are collapsed. Next, as shown by an arrow mark 44 in FIG. 4C, engagements of the ribs 40 of the tray plate 24*a* and the through holes, or slits, 42 and 44 are released, as shown in FIG. 4, the paper discharging tray 24 is developed so that the same can receive a copying paper of an intermediate size in a state where the tray plates 24*b* and 24*c* are collapsed. Lastly, if the tray plate 24*c* is pulled-up in a direction of an arrow mark 46 in FIG. 4D, the paper discharging tray 24 is made able to receive a copying paper of a maximum size in a state where all of the tray plates 24*a*–24*c* are developed.

Figure 4B:
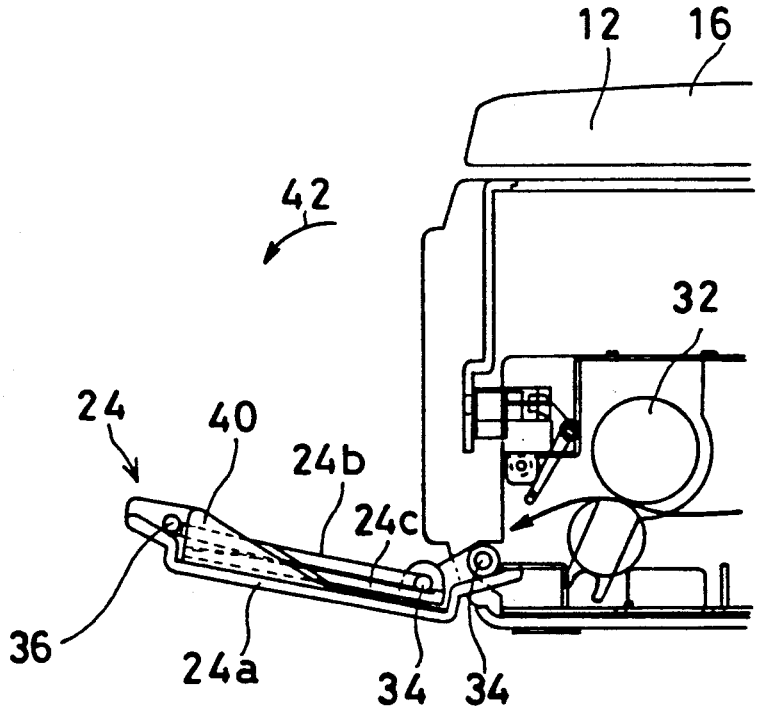
Figure 4C:
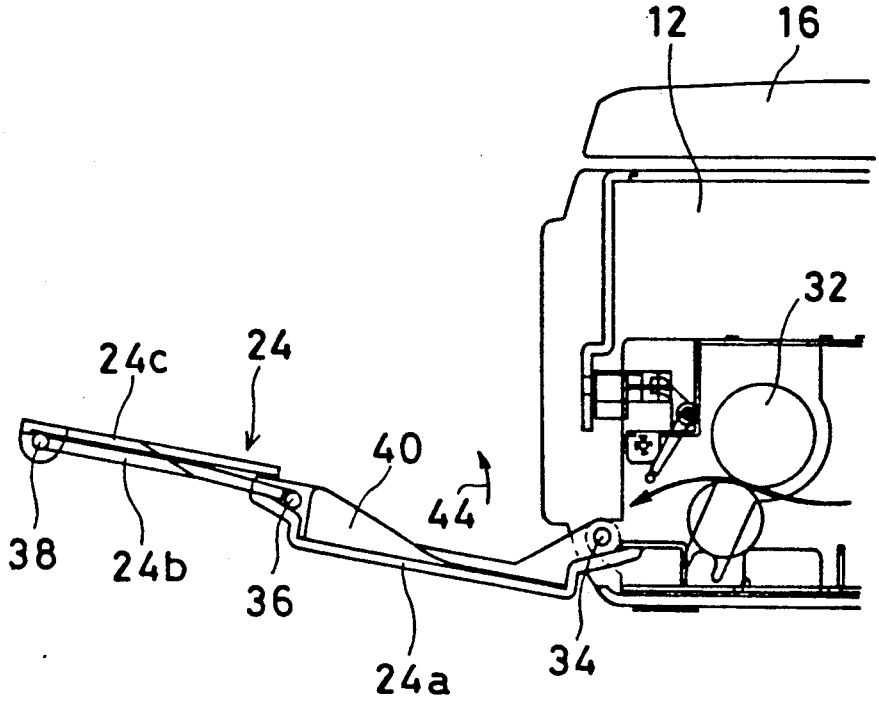
Figure 4D:
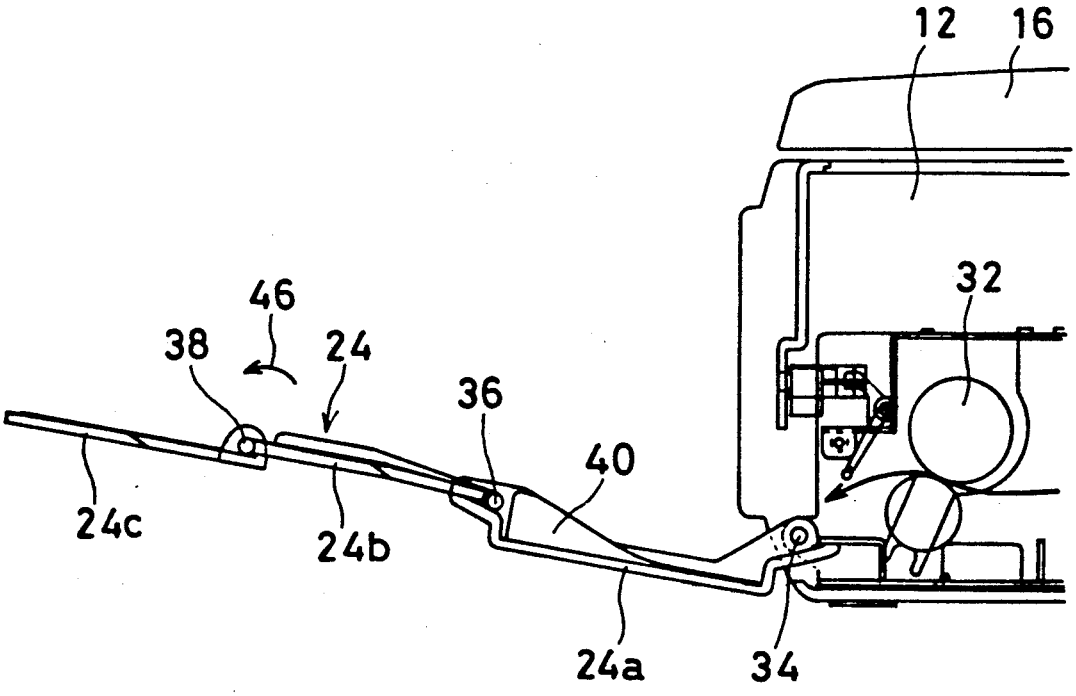

Thus, when the paper discharging tray 24 is used, if a portion or all of the tray plates 24*a*–24*c* are developed in respective states shown in FIG. 4B, FIG. 4C and FIG. 4D, it is possible to deal with respective sizes of the copying paper.

In addition, the ribs are formed on the tray plate 24*a* in a manner that each upper end rises from the center portion of the tray plate 24*a* toward the tray plate 24*b* as described above, a tip end of the copying paper to be discharged does not come in contact with a connection portion of the tray plates 24*a* and 24*b*.

Figure 5:
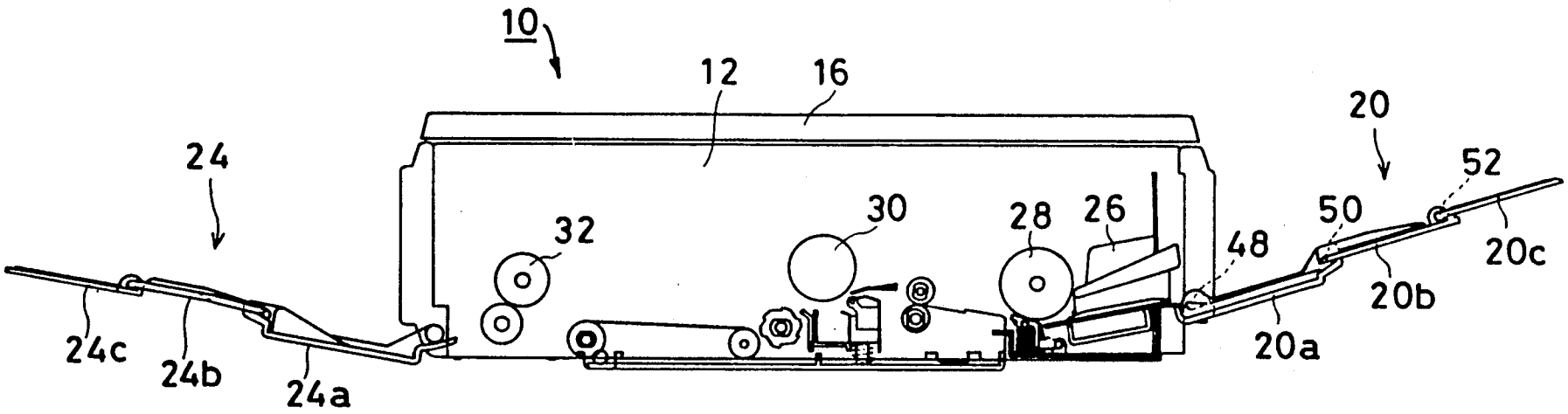
FIG. 5 is an illustrative view showing a state where a paper discharging tray and a paper feeding tray are developed in FIG. 1 embodiment.

Furthermore, as shown in FIG. 5, with respect to the paper feeding tray 20, the same or similar collapsible structure to that of the paper discharging tray 24 is adopted. More specifically, as shown in FIG. 2 and FIG. 5, the paper feeding tray 20 includes a first, a second and a third tray plates 20*a*–20*c*, and the tray plate 20*a* is attached to the body 12 in a rotatable manner by a shaft 48. The tray plates 20*a*–20*c* are coupled to each other in a rotatable manner by shafts 50 and 52. Then, the three tray plates 20*a*–20*c* are collapsed in a state shown in FIG. 2 and contained in the body 12. A portion or all of the tray plates 20*a*–20*c* can be gradually developed as similar to the tray plates 24*a*–24*c* of the paper discharging tray 24 as shown in FIGS. 4B–4D, and in FIG. 5, which shows a state where all the tray plates 20*a*–20*c* are developed.

In addition, with respect to the paper feeding tray 20, the tray plates 20*a*–20*c* are so constructed as not to be rotated more than a predetermined angle in a clockwise direction.

Figure 6:
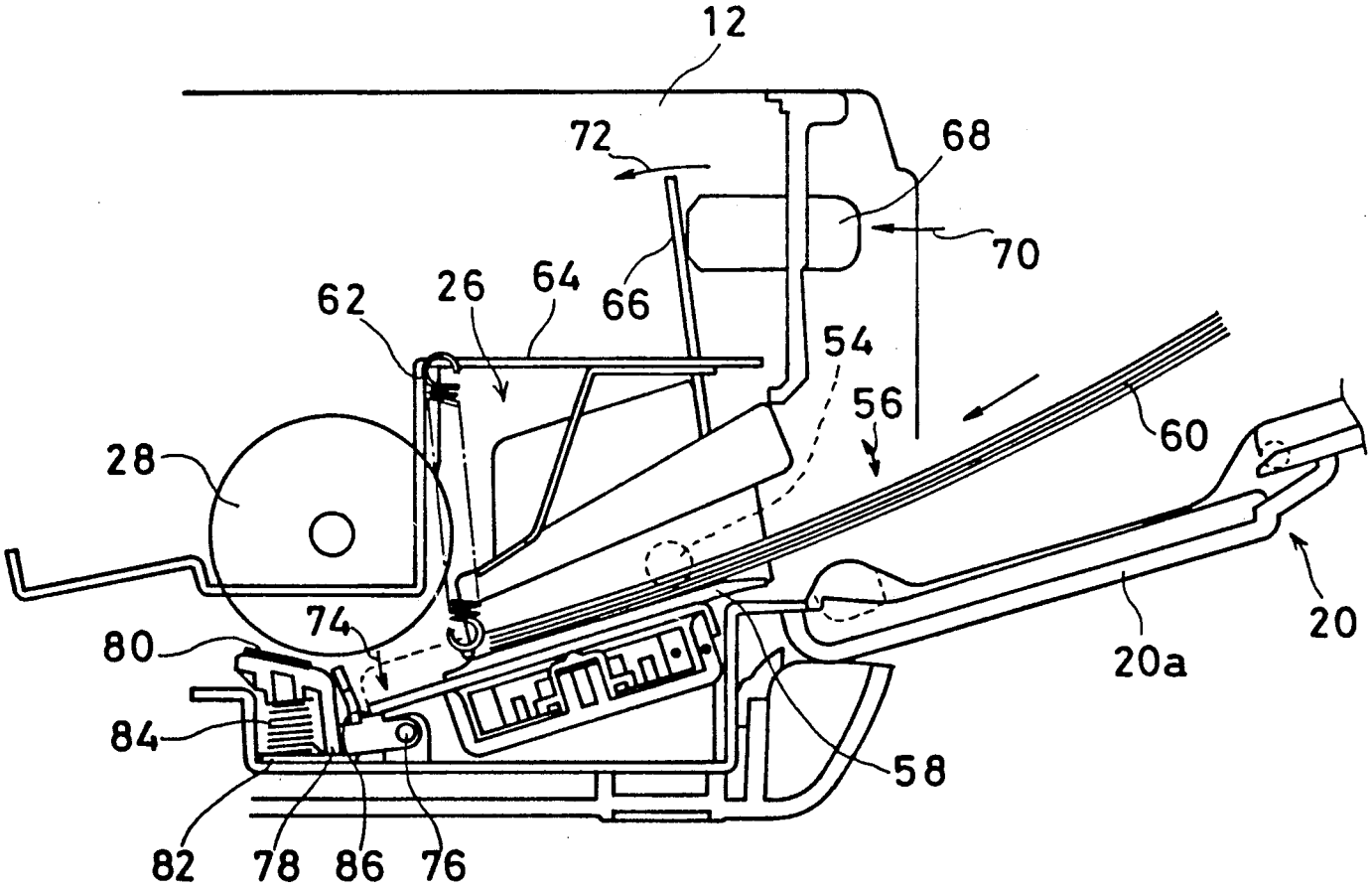
FIGS. 6–8 are illustrative views showing a paper feeding roller and major portions associated therewith in FIG. 1 embodiment.

Next, with reference to FIGS. 6–8, a paper feeding device associated with the paper feeding tray 20 will be described. As described above, the guide 26 is inserted between the paper feeding tray 20 and the paper feeding roller 28, and the guide 26 is supported by a shaft 54 in a rockable manner in a direction shown by an arrow mark 56 in FIG. 6. A guide plate 58 which guides a copying paper 60 being sent from the paper feeding tray 20 is formed on the guide 26. A tip end of the guide plate 58 is positioned below the paper feeding roller 28 and elastically pressure-contacted against a peripheral surface of the paper feeding roller 28 by means of a coil spring 62 which is hung between a frame 64 and the guide 26.

In addition, a lever 66 extending upward is fixed to the guide plate 58 and a push button 68 is provided in the vicinity of a free end of the lever 66. If the push button 68 is depressed in a direction of an arrow mark 70 in FIG. 6, the lever 66 is rotated in a direction of an arrow mark 72, and therefore, the guide plate 58 is rotated in a counterclockwise direction against a tensile force of the coil spring 62. Accordingly, the tip end of the guide plate 58 is separated from the peripheral surface of the paper feeding roller 28 so that a space through which the copying paper 60 can be inserted is formed between the guide plate 58 and the paper feeding roller 28.

Figure 7:
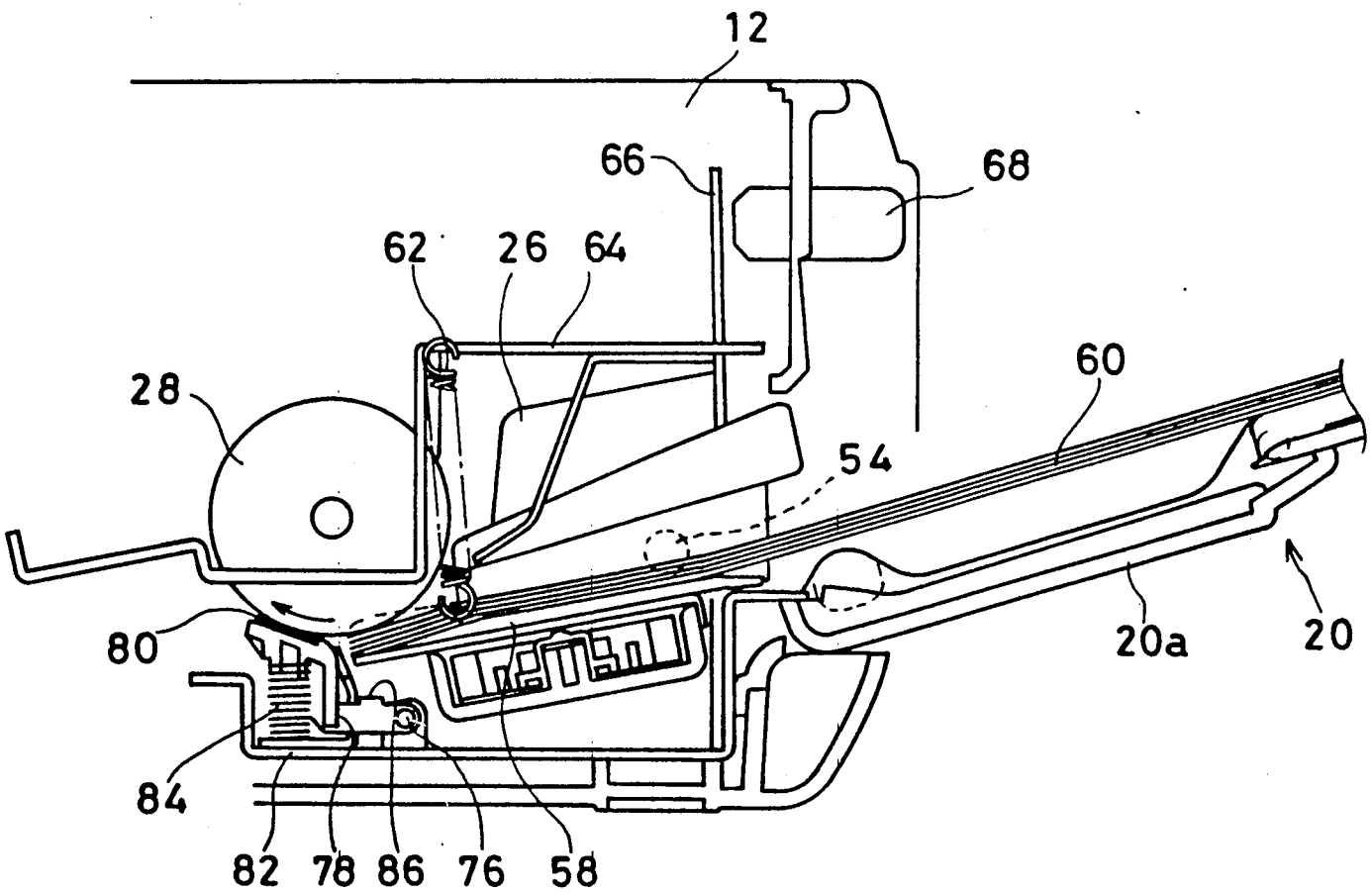

In addition, if the depression of the push button 68 is released, the guide plate 58 is rotated in a clockwise direction by the tensile force of the coil spring 62 so that the tip end of the guide plate 58 is deviated toward the peripheral surface of the paper feeding roller 28 as shown in FIG. 7.

At a downstream side of the guide plate 58 of the paper guide 26, a rockable arm 78 one end of which is supported by a shaft 76 in a rockable manner is provided below the paper feeding roller 28, and a friction pad 80 made of polyurethane rubber, for example, is fixed at a position facing the peripheral surface of the paper feeding roller 28 on the free end of the rockable arm 78. The friction pad 80 prevents by means of a friction force the copying paper 60 from being sent from the paper feeding roller 28 to the photosensitive drum 30 (FIG. 2) in a manner that one sheet lies on another. In addition, a compressed coil spring 84 is inserted between the free end of the rockable arm 78 and a frame 82, which pressure-contacts the free end of the rockable arm 78, i.e.

the friction pad 80 against the peripheral surface of the paper feeding roller 28.

In addition, a projected portion 86 is formed on the rockable arm 78, which is brought in contact with a rear surface of the tip end of the guide plate 58. Then, if the above described push button 68 is depressed, the guide plate 58 is rotated in a counterclockwise direction, and the rockable arm 78 is rotated in a counterclockwise direction against an elastic force of the coil spring 84 because the projected portion 86 is pushed by the guide plate 58.

Figure 8:
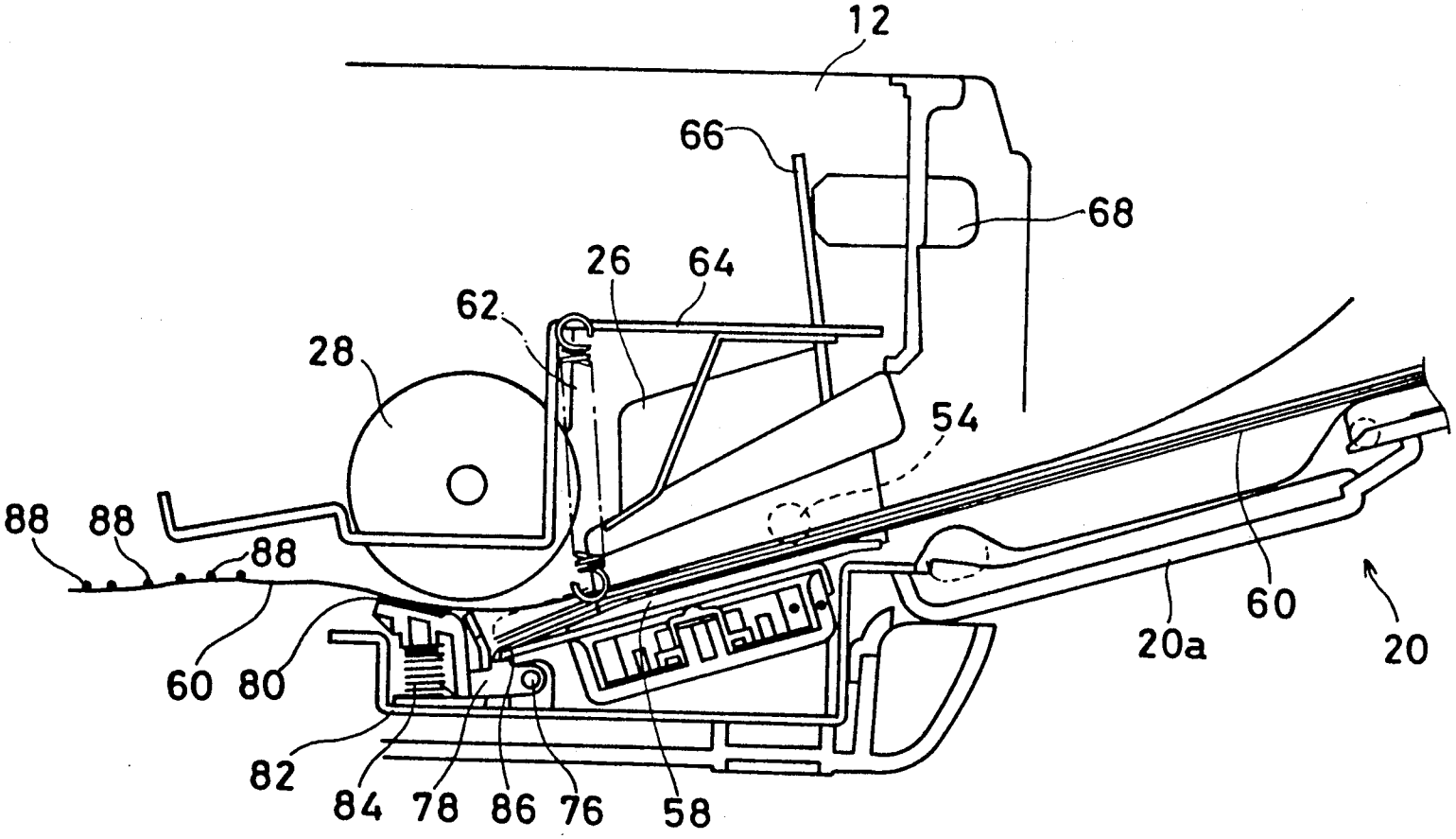
Figure 9:
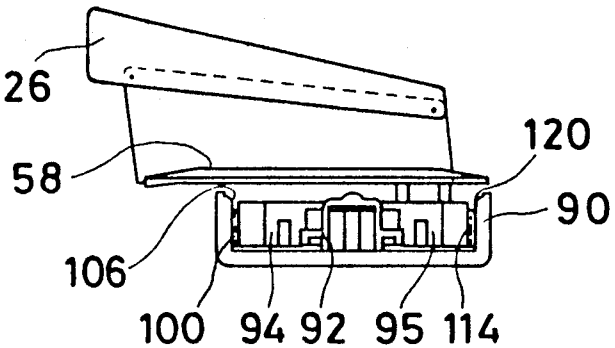
FIGS. 9, 10, 11A and 11B are illustrative views showing a paper guide of FIG. 1 embodiment.

In a case where after the copying paper 60 is sent from the paper feeding tray 20, as shown in FIG. 8, a jam takes place in a state where a toner 88 is adhered onto a portion of the copying paper 60, the push button 68 may be depressed. In response thereto, as similar to the above described case where the copying paper 60 is to be supplied (FIG. 6), a sufficiently large space is formed between the friction pad 80 and the paper feeding roller 28, and therefore, it is possible to remove the copying paper 60 being jammed while the toner 88 on the copying paper 60 is not adhered to the paper feeding roller 28.

Next, with reference to FIGS. 9–11B, the paper guide 26 will be described. There is provided with a guide holder 90 and a pinion 92 is attached in a rotatable manner at approximately center of an inside of the guide holder 90. In the guide holder 90, a first rack 94 and a second rack 95 are attached in a slidable manner, respectively, to sandwich the pinion 92. Then, one rack 94 (or 95) is moved, the pinion 92 is rotated, and thus, the other rack 95 (or 94) is moved in a reverse direction. Therefore, guide members 130 and 132 (FIG. 10) fixed to the two racks may be closed to or separated from each other.

Figure 11A:
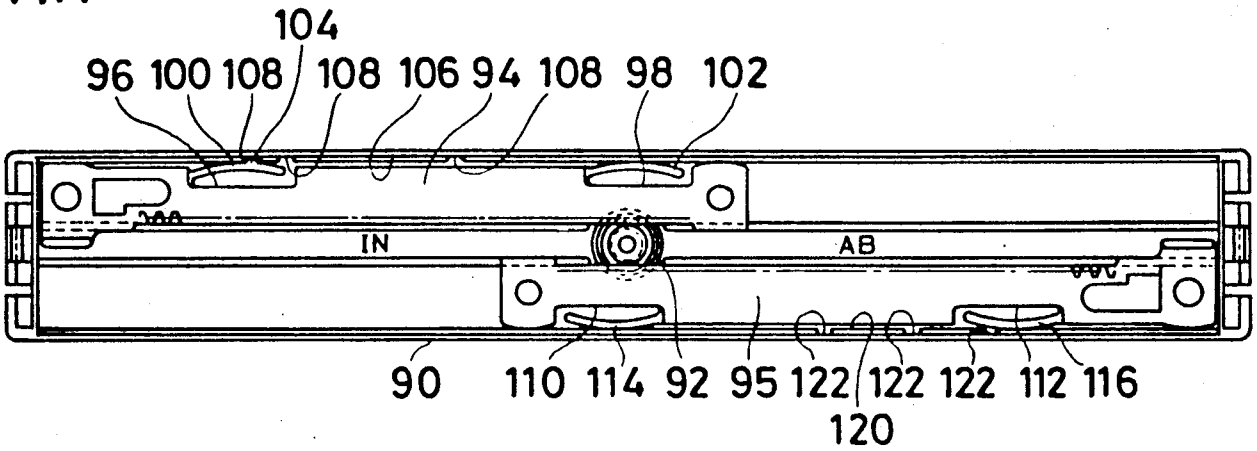
Figure 11B:
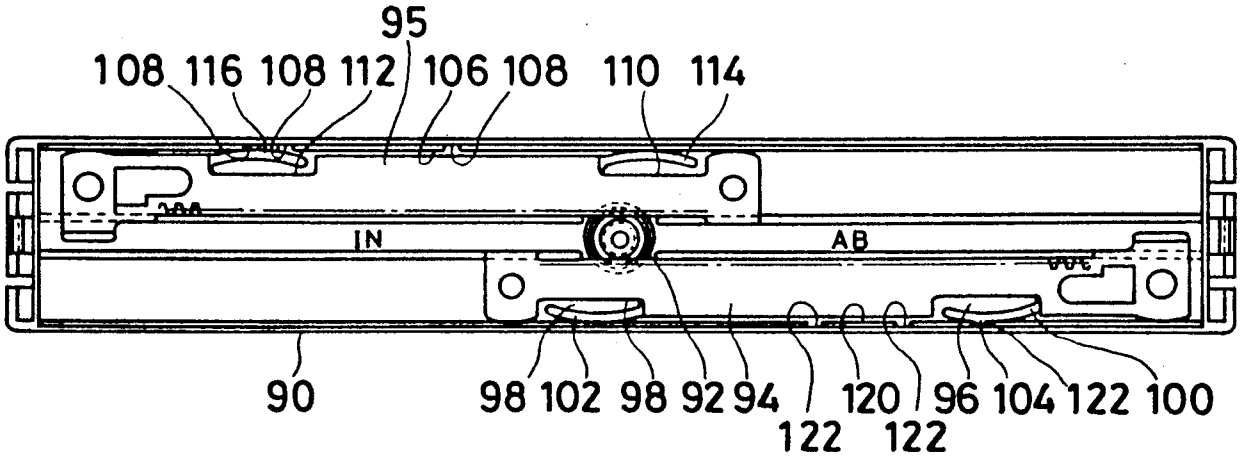

As shown in FIG. 11A and FIG. 11B, two recesses 96 and 98 are formed at its side end edge with a predetermined interval and elastic pieces 100 and 102 each being in an arc shape are formed inside the recesses 96 and 98, respectively. A projection 104 projected outwardly is formed on one elastic piece 100. Therefore, the projection 104 can be changed in position or projected or detracted in a direction intersecting a movement direction of the first rack 94. Then, a plurality of notches 108 which can engage the above described projection 104 are formed at positions corresponding to respective ones of sizes of an inch system formed on an inner edge 106 with which the side end edge of the first rack 94 of the guide holder 90 is brought in contact. In addition, on the second rack 95, as similar to the first rack 94, recesses 110 and 112, and elastic pieces 114 and 116 are formed, and a plurality of notches 122 which correspond to respective ones of sizes of the JIS (ISO) system such as "A4", "B5", and etc. are formed on an inner edge 120 of the guide holder 90 with which the side end edge of the second rack 95 is brought in contact.

In addition, the first rack 94 and the second rack 95 are respectively attached in a detachable manner to the guide holder 90. Then, in a case where paper of a size in the inch system is to be guided, as shown in FIG. 11A, the first rack 94 is attached to a side of inner edge 106 of the holder 90 and the second rack 95 is attached to a side of the inner edge 120. Then, the projection 104 of the elastic piece 100 of the first rack 94 is engaged with the notches 108 of the inner edge 106 of the guide holder 90. Therefore, the first rack 94 and the second rack 95 and thus the guide members 130 and 132 are changed in position for each size in the inch system in a clicked manner.

In addition, in a case where a paper of a size in the JIS system is to be guided, the first rack 94 and the second rack 95 are changed in position to each other, as shown in FIG. 11B, the first rack 94 is arranged at a side of the inner edge 120 of the guide holder 90 and the second rack 95 is arranged at a side of the inner edge 106. Then, the projection 104 of the elastic piece 100 of the first rack 94 is engaged with the notches 122 formed on the inner edge 120 of the guide holder 90, and therefore, the first rack 94 and the second rack 95 and thus the guide members 130 and 132 is changed in position for each size in the JIS system in a clicked manner.

In addition, it is not necessary to make coincident a distance from a center of the pinion 92 to the notch 108 of the inner edge 106 with a distance from the center of the pinion 92 to the notch 122 of the inner edge 120, and an interval of the notches 108 and an interval of the notches 122 also may not be the same.

Figure 10:
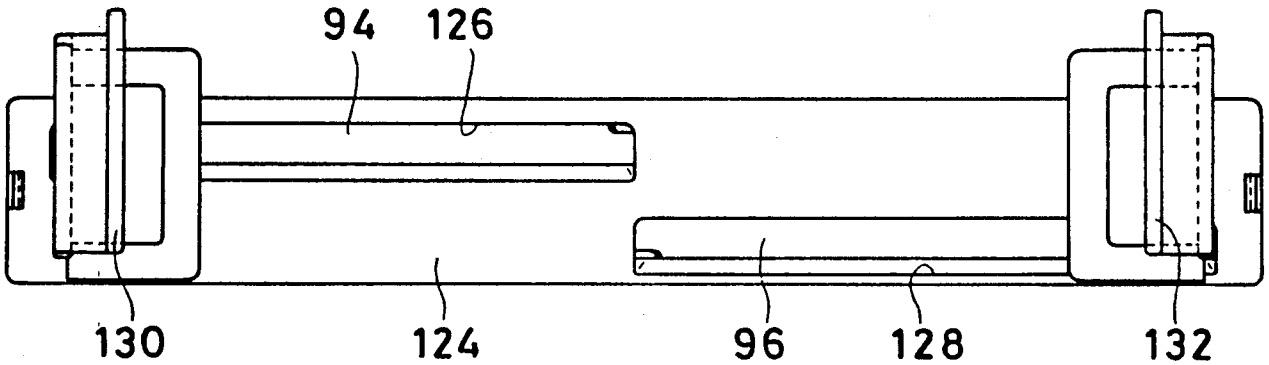

As shown in FIG. 10, an upper opening of the guide holder 90 is covered by a cover 120 which is formed with longitudinal holes 126 and 128 to be extended in a direction that the first rack 94 and the second rack 94 are moved. The guide members 130 and 132 which are brought in contact with side edges of a paper to be guided are respectively fixed to the first rack 94 and the second rack 95 through the longitudinal holes 126 and 128, therefore, by moving the first rack 94 and the second rack 95, a copying paper having a width determined by a distance between the two guide members 130 and 132 can be guided.

Figure 13:
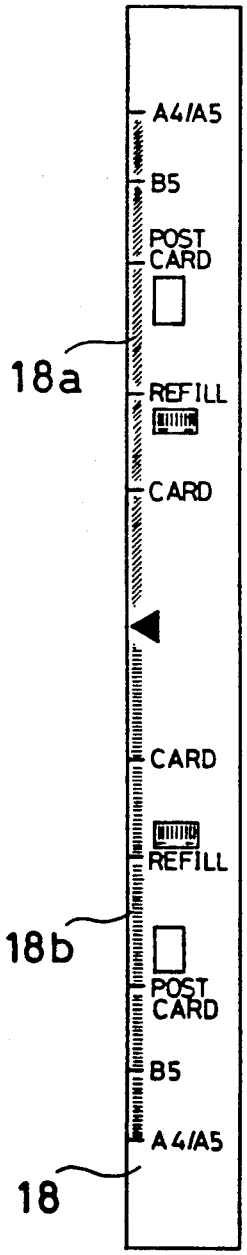
Figure 14:
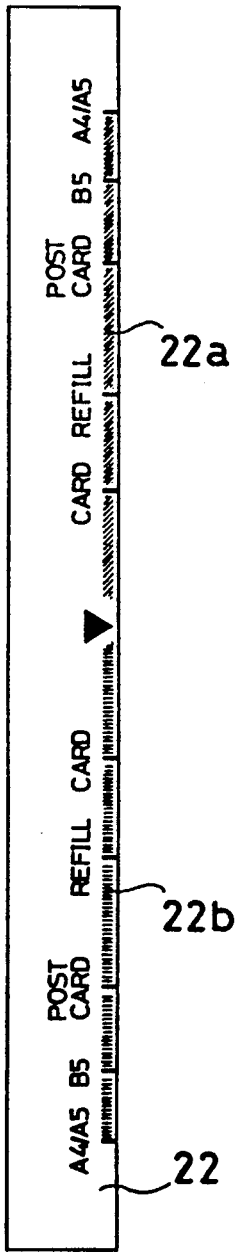

As previously described with reference to FIG. 1, the indicator 18 is formed in the vicinity of the original table 14 and the indicator 22 is formed in the vicinity of a paper feeding port of the paper feeding tray 20. Then, as shown in FIG. 13 and FIG. 14, a position of the original 138 being put on the original table 14 and a position of the copying paper 90 corresponding thereto are printed on the indicators 18 and 22 with the same symbols or patterns. More specifically, a hatching pattern **22*a* and the division are applied at a right side of the indicator 22 in a moving direction of the copying paper 90, and at a portion corresponding thereto, similar hatching pattern 18*a* and the division are applied to the indicator 18. In addition, at respective sides of the indicators 18 and 22, the same dotted patterns 18*b* and 22*b*** and the divisions are applied.

Figure 12:
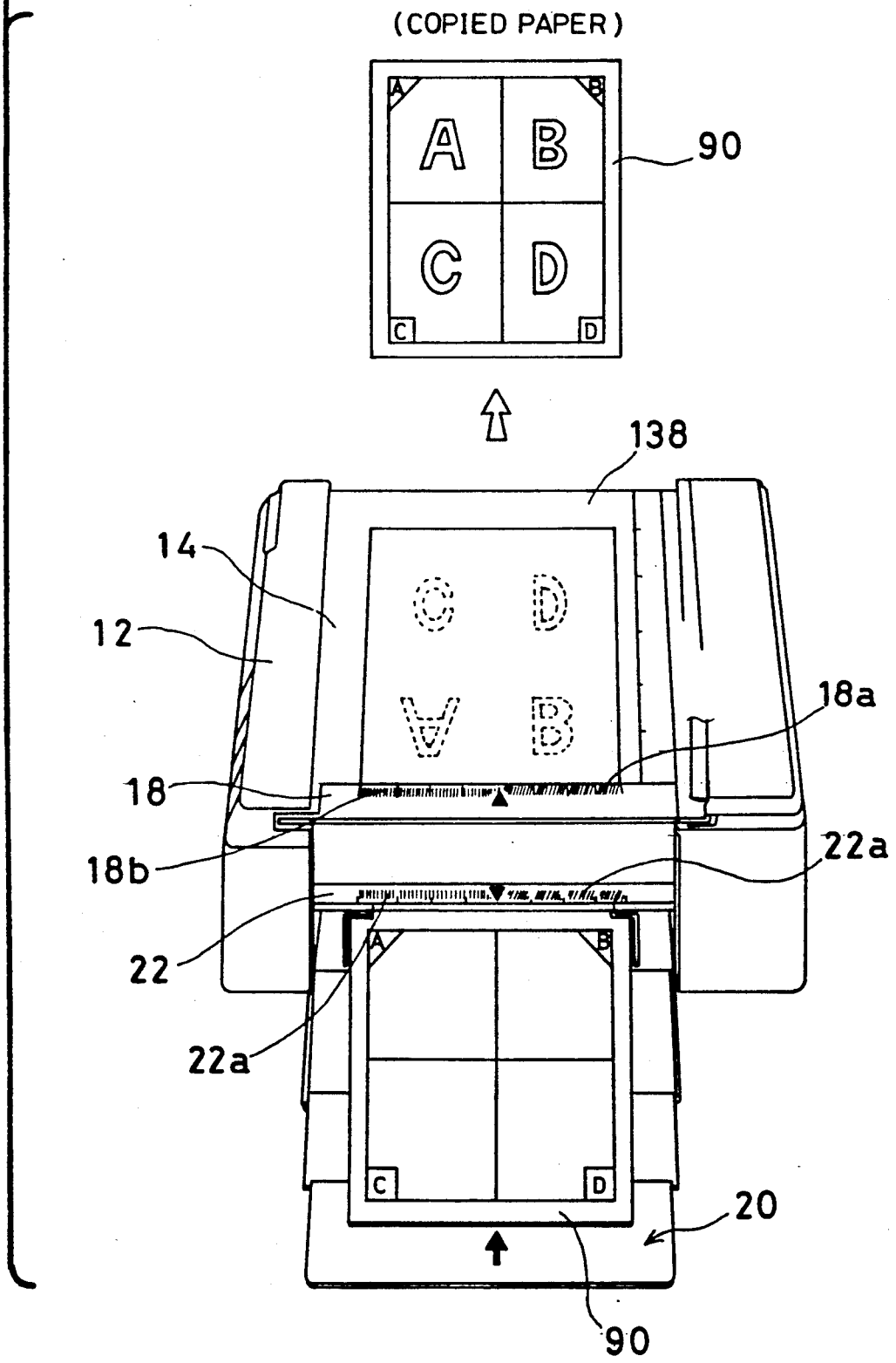
FIGS. 12–14 are illustrative views showing two indicators of FIG. 1 embodiment.

Then, as shown in FIG. 12, when an original 136 on which A, B, C and D are respectively shown in four areas is copied on a copying paper 90 divided into four areas, for example, an image of the original 136 exists at a position corresponding to a portion represented by the respective indicators 18 and 22 is formed. That is, an image of "B" exists at a portion of the original 136 which is shown by the hatching pattern **18*a*, and thus, "B" is copied at a portion of the copying paper 90 which is shown by the hatching pattern 22*a*. In addition, an image of "A" exists on the original 136 at a portion shown by the dotted pattern 18*b*, and the image "A" is copied at a portion of the copying paper 90 shown by the dotted pattern 22*b*. Therefore, an operator can clearly determine in advance whether an image of the original 136 is copied at what position of the copying paper 90 by referring the two indicators 18 and 22**, and therefore, not only the copying paper becomes not to be spent wastefully due to mistakes but also the working efficiency of the copy can be increased.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An electrophotographic copying machine, comprising:

a body;

a paper feeding tray attached to one side surface of said body, said paper feeding tray having a first, a second and a third paper feeding tray plate, means connecting said plates to each other to permit collapsing of the second plate over the first and third plate over the second and also unfolding of the second plate relative to the first plate and third plate relative to the second plate, and said first paper feeding tray plate being contained in said body in a state where said second and said third paper feeding tray plates are collapsed over said first plate; and a paper discharging tray attached to the other side surface of said body, said paper discharging tray having a first, a second and a third paper discharging tray plate, means connecting said plates to each other to permit collapsing of the second plate over the first and the third plate over the second and also unfolding of the second plate relative to the first plate and the third plate relative to the second plate, and said first paper discharging tray plate being contained in said body in a state where said second and said third paper discharging tray plates are collapsed over said first plate.

2. An electrophotographic copying machine in accordance with claim 1, wherein a plurality of ribs which are extended in a paper feeding direction are formed on one upper surface of one of said first, second and third paper feeding tray plates at predetermined spacing in a direction intersecting said paper feeding direction, and through holes, or slits, are formed on at least one other of said first, second and third paper feeding tray plates, said through holes, or slits, receiving said plurality of ribs when said first, second and third tray plates are collapsed.

3. An electrophotographic copying machine in accordance with claim 1, wherein a plurality of ribs which are extended in a paper discharging direction are formed on one upper surface of one of said first, second and third paper discharging trays plates with predetermined spacing in a direction intersecting said paper discharging direction and through holes, or slits, are formed on at least one other of said first, second and third paper discharging tray plates, said through holes, or slits, receiving said plurality of ribs when said first, second and third paper discharging tray plates are collapsed.

4. An electrophotographic copying machine in accordance with claim 3, wherein said plurality of ribs are formed on said first paper discharging tray plate, and each of said plurality of ribs is formed so that a height thereof becomes gradually larger from approximately the center of said first paper discharging tray plate in said paper discharging direction toward said second paper discharging tray plate, whereby a copying paper is prevented from being caught at a connection portion of said first and said second paper discharging tray plates.

5. An electrophotographic copying machine in accordance with claim 1, further comprising a paper feeding roller provided in said body for picking-up a copying paper put on said paper feeding tray; and guide means provided in said body between said paper feeding tray and said paper feeding roller for guiding the copying paper from said paper feeding tray to said paper feeding roller.

6. A electrophotographic copying machine in accordance with claim 5, wherein said guide means includes a box-shaped guide holder; a pinion rotatably mounted in said guide holder; first and second racks arranged in parallel with each other to sandwich said pinion, each of said first and second racks being detachably attached to said guide holder, and said first rack having a first projection formed to be projected and retracted in a direction intersecting a movement direction of said first rack; a plurality of first notches formed at a portion of said guide holder in contact with said first rack and engaged with said first projection at different positions; and a plurality of second notches formed at a portion of said guide holder in contact with said second rack and engaged with said first projection at different positions.

7. An electrophotographic copying machine in accordance with claim 6, wherein the distance from a center of said pinion to a said first notch and a distance from a center of said pinion to a said second notch are set to be different from each other.

8. An electrophotographic copying machine in accordance with claim 6, wherein the spacing between said first notches and the spacing between said second notches are set to be different from each other.

9. An electrophotographic copying machine in accordance with claim 5, wherein said guide means includes a rockable guide plate, a tip end of said guide plate being positioned below the paper feeding roller; a first spring for pressure-contacting said tip end of said guide plate against a peripheral surface of said paper feeding roller; and means for detaching said tip end of said guide plate from said peripheral surface of said paper feeding roller against said first spring.

10. An electrophotographic copying machine in accordance with claim 9, further comprising a rockable arm in the vicinity of said peripheral surface of said paper feeding roller; a friction pad provided at one end of said arm; a second spring for acting on said arm and for pressure-contacting said friction page against said peripheral surface of said paper feeding roller; and means for separating said friction page from said peripheral surface of said paper feeding roller against said second spring when said detaching means is operated.

11. An electrophotographic copying machine in accordance with claim 1, further comprising an original table on said body;

a first indicator means on one end edge of said original table; and second indicator means corresponding to the width of said paper feeding tray, each of said first and second indicator means having a symbol at a corresponding point thereon to determine the position of the copying paper in the paper feeding tray relative to the original table.

12. An electrophotographic copying machine in accordance with claim 11, wherein said second indicator means is formed on an end of said body adjacent an end of said paper feeding tray.

13. An electrophotographic copying machine, comprising:

a body;

a paper feeding tray attached to one side surface of said body, a paper discharging tray attached to the other side surface of said body;

a paper feeding roller provided in said body for picking up a copying paper put on said paper feeding tray; and guide means provided in said body between said paper feeding tray and said paper feeding roller for guiding the copying paper from said paper feeding tray to said paper feeding roller, said guide means including a box-shaped guide holder; a pinion rotatably mounted in said guide holder; first and second racks arranged in parallel with each other so as to sandwich said pinion, each of said first and second racks being detachably attached to said guide holder, and said first rack having a first projection formed to be projected and retracted in a direction intersecting a movement direction of said first rack; a plurality of first notches formed at a portion of said guide holder in contact with said first rack and engaged with said first projection at different positions; and a plurality of second notches formed at a portion of said guide holder in contact with said second rack and engaged with said first projection at different positions.

14. An electrophotographic copying machine, comprising:

a body;

a paper feeding tray attached to one side surface of said body, a paper discharging tray attached to the other side surface of said body;

a paper feeding roller provided in said body for picking-up a copying paper put on said paper feeding tray; and guide means provided in said body between said paper feeding tray and said paper feeding roller for guiding the copying paper from said paper feeding tray to said paper feeding roller, said guide means including a rockable guide plate, a tip end of said guide plate being positioned below the paper feeding roller; a first spring for pressure-contacting said tip end of said guide plate against a peripheral surface of said paper feeding roller; and means for detaching said tip end of said guide plate from said peripheral surface of said paper feeding roller against said first spring;

a rockable arm provided in the vicinity of said peripheral surface of said paper feeding roller;

a friction pad provided at one end of said arm;

a second spring for acting on said arm and for pressure-contacting said friction pad against said peripheral surface of said paper feeding roller; and means for separating said friction pad from said peripheral surface of said paper feeding roller against said second spring when said detaching means is operated.

15. An electrophotographic copying machine, comprising:

a body;

a paper feeding tray attached to one side surface of said body, a paper discharging tray attached to the other side surface of said body;

an original table on said body;

first indicator means on one end edge of said original table; and and second indicator means comprising to the width of said paper feeding tray, each of said first and second indicator means having a symbol at a corresponding point therein to determine the position of the copying paper in the paper feeding tray relative to the original table.

* * * * *